US009644284B2

(12) United States Patent
Ostrovsky

(10) Patent No.: US 9,644,284 B2
(45) Date of Patent: May 9, 2017

(54) METHOD FOR PRODUCING A HARD COATING WITH HIGH CORROSION RESISTANCE ON ARTICLES MADE OF ANODIZABLE METALS OR ALLOYS

(75) Inventor: Ilya Ostrovsky, Alonim (IL)

(73) Assignee: Chemetall GmbH (DE)

( * ) Notice: Subject to any disclaimer, the term of this patent is extended or adjusted under 35 U.S.C. 154(b) by 732 days.

(21) Appl. No.: 13/186,741

(22) Filed: Jul. 20, 2011

(65) Prior Publication Data

US 2011/0303547 A1 Dec. 15, 2011

Related U.S. Application Data

(63) Continuation of application No. 12/484,490, filed on Jun. 15, 2009, now abandoned, which is a continuation of application No. 10/898,152, filed on Jul. 23, 2004, now abandoned.

(51) Int. Cl.
*C25D 11/36* (2006.01)
*C25D 11/02* (2006.01)

(52) U.S. Cl.
CPC ..... *C25D 11/36* (2013.01); *C25D 11/024* (2013.01); *C25D 11/026* (2013.01)

(58) Field of Classification Search
CPC ..... C25D 11/36
USPC ..... 205/318
See application file for complete search history.

(56) References Cited

U.S. PATENT DOCUMENTS

| | | | |
|---|---|---|---|
| 4,659,440 | A | 4/1987 | Hradcovsky |
| 4,978,432 | A | 12/1990 | Schmeling et al. |
| 5,275,713 | A | 1/1994 | Hradcovsky |
| 5,385,662 | A | 1/1995 | Kurze et al. |
| 5,616,229 | A | 4/1997 | Samsonov et al. |
| 5,792,335 | A | 8/1998 | Barton |
| 6,280,598 | B1 | 8/2001 | Barton et al. |
| 6,365,028 | B1 | 4/2002 | Shatrov |
| 2003/0000847 | A1 | 1/2003 | Ostrovsky |
| 2003/0186972 | A1 | 10/2003 | Shatrov et al. |
| 2004/0182481 | A1 | 9/2004 | Smith |

FOREIGN PATENT DOCUMENTS

| | | | | |
|---|---|---|---|---|
| DE | 42 09 733 | A1 | 9/1993 | |
| EP | 0 823 496 | | 2/1998 | |
| EP | 1050606 | A1 | 11/2000 | |
| RU | 2 070 622 | C1 | 12/1996 | |
| SU | 1200591 | A | 4/1989 | |
| SU | 1713990 | A2 | 2/1992 | |
| SU | 1824950 | | 5/1995 | |
| WO | 9945177 | A2 | 9/1999 | |
| WO | WO 02096475 | A1 * | 12/2002 | ..... A61L 27/06 |
| WO | WO 03/002773 | A2 | 1/2003 | |

OTHER PUBLICATIONS

Machine Translation of SU 1824950 A1.*

* cited by examiner

*Primary Examiner* — Bryan D. Ripa

(57) ABSTRACT

A method for coating, a composition suitable for coating and a coating generated with the method of coating on anodizable metallic surfaces, especially on magnesium rich and aluminum rich surfaces, is disclosed. The composition is an aqueous solution including alkali metal or ammonium cations, phosphorus containing anions and silicon containing anions as well as optionally a peroxide or a compound of Al, Ti, Zr or any mixture of them. Preferably, the anodizing is carried out with a micro-arc oxidation process.

22 Claims, 1 Drawing Sheet

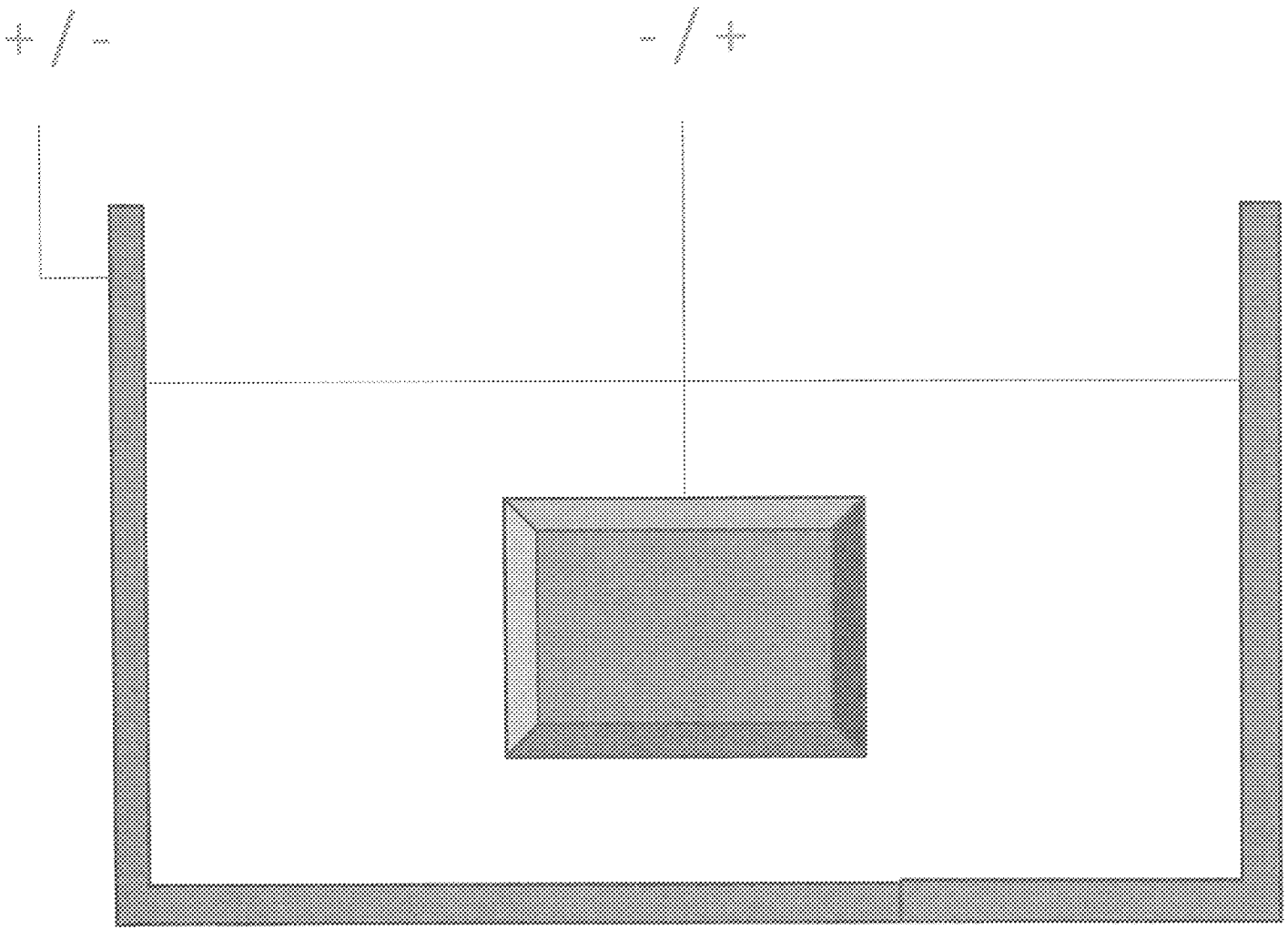

METHOD FOR PRODUCING A HARD COATING WITH HIGH CORROSION RESISTANCE ON ARTICLES MADE OF ANODIZABLE METALS OR ALLOYS

This application is a continuation application of U.S. Ser. No. 12/484,490 filed Jun. 15, 2009 now abandoned which is a continuation application of U.S. Ser. No. 10/898,152 filed Jul. 23, 2004 now abandoned, each of which is incorporated by reference herein in its entirety.

FIELD OF THE INVENTION

The present invention is directed to the field of metal surface preparation utilizing anodizing processes with aqueous compositions suitable for the anodizing of anodizable metallic materials. In preferred embodiments the invention relates to a method and a composition of anodizing surfaces of anodizable metallic materials by a micro-arc oxidation process especially of surfaces of magnesium, magnesium alloys, aluminum, aluminum alloys or these mixtures or of surfaces or surfaces' mixtures containing such metallic materials.

BACKGROUND OF THE INVENTION

The light weight and strength of magnesium and magnesium alloys makes products fashioned therefrom highly desirable for use in manufacturing critical components to be used, for example, for aircraft, for terrestrial vehicles or for electronic devices. But the most significant disadvantage of magnesium and magnesium alloys that they easily corrode. The exposure of such metallic materials' surfaces to a chemically hazardous environment causes that their surfaces corrode rather quickly and strongly. Corrosion is both unesthetic and reduces strength.

There are many methods known for improving the corrosion resistance of a workpiece of magnesium and magnesium alloy by modifying the surface of the workpiece. It is generally accepted that the best corrosion resistance for magnesium and magnesium alloy surfaces is achieved by anodizing. In the anodizing process, a metallic workpiece is used as an anode or with an alternating current as an anode and as a cathode alternating according to the frequency of the alternating current of an electrical circuit, the circuit including an electrolyte bath in which the workpiece is at least partially immersed. Depending on the properties of the current, the bath temperature and the composition of the solution of the electrolyte bath, the surface of the workpieces may be modified in various ways. The metallic workpiece (substrate, article) may be a coil, a sheet, a wire, a workpiece made from a coil respectively from a sheet or a more or less massive part with a simple or complex shape.

Various solutions and additives are found for example in; U.S. Pat. No. 5,792,335 discloses ammonia and phosphate containing electrolyte solutions with an optional content of ammonium salt and peroxide; U.S. Pat. No. 6,280,598 teaches electrolyte solutions that may contain different amines or ammonia and phosphate or fluoride and subsequently a sealing agent may also be applied; WO 03/002773 describes electrolyte solutions containing phosphate, hydroxylamine and alkali metal hydroxide. The anodizing methods disclosed in these publications allow a layer comprising magnesium hydroxide and magnesium phosphate. These anodizing processes offer high corrosion resistance.

Although anodizing is effective in increasing the corrosion resistance, the hardness and the scratch resistance of the surfaces are often insufficient especially for anodizing coatings generated on the surface of magnesium rich material, primarily because a high concentration of magnesium hydroxide in the generated anodizing coatings. In conventional anodizing processes even on the surfaces of materials rich in aluminum, beryllium, iron or titanium, the generated anodizing coatings are typically rich in at least one hydroxide and therefore not as hard as expected. On the other hand, the processes of anodizing based on acidic electrolyte solutions do not offer a sufficiently high corrosion resistance.

One of the ways to solve this problem is to apply a coating rich in ceramic oxides especially by micro-arc electrolytic oxidation process.

The investigation of micro-arc electrolytic oxidation for light metals has continued for more than fifty years. The micro-arc oxidation method has several names: Micro-arc oxidation, micro-plasmic oxidation, plasma-liquid coating, etc. Methods and compositions to apply a ceramic oxide coating by anodizing on aluminum have been disclosed in several publications: SU 1200591 teaches to build an oxide coating with high hardness and wear resistance in alkaline solutions of potassium hydroxide, "liquid glass" (=water glass) and sodium aluminate. An alternating current with a frequency of about 50 Hz and with a current density in the range from 0.5 to 24 A/dm$^2$ (current density of the cathodic phase) and in the range from 0.6 to 25 A/dm$^2$ (current density of the anodic phase) is supplied to the metallic material. DE 42 09 733 teaches an anode-cathode oxidation in an alkali metal silicate or in an alkali metal aluminate electrolyte solution. Pulses with a frequency in the range from 10 to 150 Hz are used. The method offers solid oxide coatings with a thickness in the range from 50 to 250 microns and requires a very high energy consumption and a complex equipment. U.S. Pat. No. 5,616,229 discloses a method of obtaining a ceramic oxide coating on aluminum. The method uses again potassium hydroxide and silicate in the electrolyte solution.

A general drawback of alkali metal hydroxide and silicate containing electrolyte solutions is the low stability of the said electrolyte solutions. By applying the typical electricity for such a process, the electrolyte solution changes within a short time—especially after the use from about 30 to about 90 A·h/L to a kind of gel because of the high polymerization of the solution and should therefore be completely replaced.

U.S. Pat. No. 4,659,440 teaches a method of coating aluminum articles in electrolyte solutions comprising an alkali metal silicate, a peroxide, an organic acid and a fluoride. A vanadium compound may also be included for decorative purposes. U.S. Pat. No. 5,275,713 discloses a method of coating aluminum surfaces with an electrolyte solution containing alkali metal silicate, an organic acid, potassium hydroxide, a peroxide, a fluoride and molybdenum oxide. The voltage is first raised to 240 to 260 V and then increase the voltage to a range from 380 to 420 V. U.S. Pat. No. 5,385,662 teaches a method of producing oxide ceramic layers on barrier layer-forming metals which include aluminum or magnesium rich metallic surfaces. The electrolyte solutions contain ions of phosphate, borate and fluoride.

A main drawback of the described electrolyte solutions described in these publications is the content of hazardous components like fluorides and heavy metals.

RU 2070622 and U.S. Pat. No. 6,365,028 disclose methods for producing ceramic oxide coatings on aluminum in electrolyte solutions comprising an alkali metal hydroxide, an alkali metal silicate and an alkali metal pyrophosphate. An alternating current with a frequency in the range from 50 to 60 Hz is supplied to the metal. The addition of pyrophosphate ions to the classic combination of alkali metal hydroxide and silicate improves the stability of the electrolyte solution. In order to accelerate the oxide layer formation, the inventor used peroxide additives in the second patent publication mentioned here. A drawback of the disclosed method is the high content of the alkali metal hydroxide that is undesirable for magnesium rich surfaces because of high contents of magnesium hydroxide in the generated coatings.

A high content of an alkali metal hydroxide in the electrolyte solution accelerates the formation of magnesium hydroxide and magnesium oxide on the metallic surfaces and assists in producing coatings with a low hardness and with a low stability against acids. Additionally, a significant content of at least one metal hydroxide seems to reduce the stability of the silicate containing electrolyte solutions severely. U.S. Pat. No. 4,978,432 teaches to produce protective coatings that are resistant to corrosion and wear on magnesium and magnesium alloys. The electrolyte solutions comprise ions of borate or sulfonate, phosphate and fluoride or chloride. The obtained coatings include magnesium phosphate and magnesium fluoride and optionally magnesium aluminate that offer good corrosion and wear resistance. However, the electrolyte solutions are not sufficiently environmentally friendly.

A method that is similar to the proposed invention is disclosed in SU 1713990. It teaches a method of micro-arc anodizing for metals in alkaline electrolyte solutions. The anodizing is performed by an asymmetric AC current so that the hardness is increased because of a good sintering. The current density is decreased by steps in the range from 20 to 60%. The disclosed compositions which include sodium hexametaphosphate ($Na_6P_6O_{18}$) do not include a second phosphorus containing compound and no addition of any alkali metal hydroxide. A main drawback of the disclosed method is the complex electrical control and the low rate of the coating formation. The method has not been adapted and not optimized for magnesium rich surfaces.

WO 03/002773 discloses a method of anodizing magnesium surfaces in alkaline phosphate solutions. The method allows to build quickly anodizing layers that contain a magnesium phosphate. The generated layers offer excellent corrosion resistance and good adhesion. The coating method was approved for application in aircraft industries. However, the coatings have a low hardness because of a high content of magnesium oxide and magnesium hydroxide.

It would be highly advantageous to have a method for treating the surfaces of anodizable metallic materials and especially magnesium or magnesium alloy surfaces so as to generate coatings of a high hardness and of a high corrosion resistance. Further on, it is preferable that such a treatment is environment friendly and does not include a considerable content of fluorides, heavy metals and other hazardous components. It would be favorable if this process would be not too complex and not too expensive.

SUMMARY OF THE INVENTION

The present invention relates to a composition of an aqueous electrolyte solution useful for the oxidation of a surface of at least one anodizable metallic material with a pH greater than 6 comprising:

i. at least two different phosphorus containing compounds having different anions which are at least partially soluble in the aqueous solution used, at least a first being called component a) and at least a second being called component b);

ii. at least one silicon containing compound which is at least partially soluble in the aqueous solution used; and iii. an amount of at least one type of cations selected from alkali metal cations and ammonium cations;

iv. whereby the electrolyte solution shows a total concentration of at least one hydroxide of Na, K, Li, $NH_4$ or any mixture of these intentionally added to the electrolyte solution below 0.8 g/L or whereby the electrolyte solution is free of any hydroxide of Na, K, Li, $NH_4$ or any mixture of these added intentionally.

The present invention relates further on to a composition of an aqueous electrolyte solution useful for the oxidation of a surface of at least one anodizable metallic material with a pH greater than 6 comprising:

i. at least two different phosphorus containing compounds showing different anions which are at least partially soluble in the aqueous solution used, at least two of them being called component a) and component b), wherein there is contained a moiety of at least one phosphorus containing compound showing oxyanions;

ii. an amount of at least one compound selected from organic silicates, inorganic silicates, silicon containing oxides, silanes, silanols, siloxanes and polysiloxanes, their derivatives or any mixture of them that are sufficiently stable in the electrolyte solution, essentially non-toxic and water-soluble or at least partially water-soluble;

iii. a moiety (compound) of at least one of the cations of Na, K, Li, $NH_4$ or any mixture of these;

iv. whereby the electrolyte solution shows a total concentration of at least one hydroxide of Na, K, Li, $NH_4$ or any mixture of these intentionally added to the electrolyte solution below 0.8 g/L or whereby the electrolyte solution is free of any hydroxide of Na, K, Li, $NH_4$ or any mixture of these added intentionally.

The present invention relates additionally to a method of treating a metallic workpiece comprising:

a) providing a metallic surface chosen from metallic surfaces of at least one metallic material that may be anodized;

b) immersing said surface in an electrolyte solution whereby the solution may really be a solution, a sol, a gel, a suspension or any mixture of them;

c) providing at least one electrode in said electrolyte solution; and d) passing a current between said surface and said electrode through said electrolyte solution wherein said electrolyte solution is an aqueous solution with a piT greater than 6 that has a composition according to the invention. As noted above, the electrolyte solution may take different forms, such as a solution, a sol, a gel, a suspension or any mixture of them; and the term electrolyte bath may be used to refer to any such form.

The present invention relates even to a protective coating produced by a method according to the invention.

The present invention relates finally to a method of use of a metallic workpiece coated with a protective coating which is produced by a method according to the invention for aircrafts, for terrestrial vehicles or for electronic devices.

BRIEF DESCRIPTION OF THE FIGURE

The FIGURE shows an embodiment of the invention.

DETAILED DESCRIPTION OF THE INVENTION

The present invention concerns a method of treating a metallic workpiece in an electrolyte solution by anodizing, a composition useful for such anodizing and a coating generated therewith whereby the anodizing is favorably carried out with a micro-arc oxidation process, especially on magnesium rich or on aluminum rich surfaces. The composition is an aqueous solution including i) at least two phosphorus compounds like a combination of an orthophosphate and a pyrophosphate, ii) at least one silicon containing compound like an alkali metal silicate, iii) a content of at least one alkali metal compound or ammonium compound or both and optionally a) a not too high content of at least one hydroxide, b) a peroxide or c) at least one compound comprising atoms of Al, Ti, Zr or any mixture of these chemical elements resp. a combination of such silicon respectively aluminum, titanium, zirconium or any combination of them containing compounds or any combination of compounds selected from the group consisting of a), b) and c).

Compositions of the Electrolyte Solution of the Present Invention

The compounds mentioned herein may be present in the electrolyte solution in the form of compounds, of their ions or of both of them.

The composition of the electrolyte solution contains preferably a moiety of at least one type of anions selected from phosphorus containing oxyanions.

The composition of the electrolyte solution contains preferably a moiety of at least one primary phosphate, of at least one secondary phosphate, of at least one orthophosphate, of at least one condensed phosphate like of at least one metaphosphate or of at least one polyphosphate or of both, of at least one pyrophosphate, of at least one phosphonate, of at least one phosphonite, of at least one phosphite, of at least one derivative of them or of any mixture of them.

The composition of the electrolyte solution contains preferably:

As component a) a moiety (compound) of at least one primary, secondary or tertiary phosphate or of at least one derivative of them or of any mixture of them and as component b) a moiety (compound) of at least one pyrophosphate or of at least one derivative of it or of any mixture of them.

The composition of the electrolyte solution contains preferably at least one of said phosphorus containing compounds chosen from the group consisting of $K_3PO_4$, $Na_3PO_4$, $(NH_4)_3PO_4$, $K_2HPO_4$, $Na_2HPO_4$, $(NH_4)_2HPO_4$, $KH_2PO_4$, $NaH_2PO_4$, $NH_4H_2PO_4$, $K_4P_2O_7$, $Na_4P_2O_7$ and $(NH_4)_4P_2O_7$. It is clear to one skilled in the art that alternatively or additionally to these other phosphates that are sufficiently soluble in the electrolyte solution may be incorporated in the electrolyte solution.

The electrolyte solution of the present invention contains preferably at least one alkali metal pyrophosphate or ammonium pyrophosphate or both, preferably added as at least one water-soluble phosphate salt, more preferred selected from potassium pyrophosphate ($K_4P_2O_7$), sodium pyrophosphate ($Na_4P_2O_7$) and any mixture of these. The total concentration of said pyrophosphate(s) is preferably in the range from 0.001 to 2 M/L or is preferably in the range from 0.1 to 240 g/L, e.g. preferably 3, 6, 9, 12, 15, 18, 21, 24, 27, 30, 33, 36, 39, 42, 45, 48, 51, 54, 57 or 60 g/L.

An electrolyte solution with a too high concentration of the phosphorus containing compounds may provide thick, fragile coatings. An electrolyte solution with too low of a concentration of the phosphorus containing compounds may form inhomogeneous unesthetic layers, especially on complex forms of workpieces like such with deepenings recesses, or concavities. An electrolyte solution with a too high concentration of hydrophosphate or of pyrophosphate or of both may provide thick, fragile coatings. An electrolyte solution with a too low concentration of hydrophosphate or of pyrophosphate or of both may be of a relatively low pH and may form inhomogeneous unesthetic layers and in some cases the electrolyte solution may earlier alter to a gel like composition. Although not intending to be bound to any of the theories of anodizing technologies, it is believed that the presence of the pyrophosphate ions in the electrolyte solution of the present invention contributes to the stability of the electrolyte solution, that means that the life time of the electrolyte solution is not too much altered to a thickened gel like composition.

The crystal water content of these compounds may be e.g. zero or as usually known for the respective compound or intermediate between such data. In the calculations, the water content of such compounds has to be considered, too, even if it is not mentioned in the formulas of this text.

The composition of the electrolyte solution contains preferably the at least two phosphorus containing compounds in a total concentration in the range from 0.2 to 250 g/L, more preferred in the range from 0.5 to 180 g/L, most preferred in the range from 1 to 120 g/L, often in the range from 2 to 80 g/L, whereby the concentration is calculated under consideration of a crystal water content if present. This total concentration may especially be e.g. 3, 6, 9, 12, 15, 18, 21, 24, 27, 30, 33, 36, 39, 42, 45, 48, 51, 54, 57, 60, 65, 70, 75, 80, 85 or 90 g/L.

The composition of the electrolyte solution contains the at least two phosphorus containing compounds preferably in a total amount in the range from 0.001 to 2 M/L, more preferred in the range from 0.02 to 1.2 M/L, most preferred in the range from 0.05 to 0.8 M/L, often in the range from 0.01 to 0.5 M/L, whereby the concentration is calculated under consideration of a crystal water content if present.

The composition may preferably contain said component a) in a concentration in said electrolyte solution in the range from 0.1 to 220 g/L and may preferably contain said component b) in said electrolyte solution in the range from 0.1 to 220 g/L, more preferred the component a) in the range from 0.2 to 160 g/L, most preferred in the range from 0.3 to 100 g/L, often in the range from 0.5 to 75 g/L, and more preferred the component b) in the range from 0.2 to 160 g/L, most preferred in the range from 0.3 to 100 g/L, often in the range from 0.5 to 75 g/l, whereby the concentration is calculated under consideration of a crystal water content if present. The concentration of said component a) or of said component b) may especially be e.g. 3, 6, 9, 12, 15, 18, 21, 24, 27, 30, 33, 36, 39, 42, 45, 48, 51, 54, 57 or 60 g/L.

The composition may preferably contain said component a) in a concentration in said electrolyte solution in the range from 0.002 to 1.8 M/L and may preferably contain said component b) in said electrolyte solution in the range from 0.002 to 1.8 M/L. More preferred, the component a) is contained in the range from 0.0012 to 1.4 M/L, most preferred in the range from 0.003 to 1 M/L, often in the range from 0.005 to 0.5 M/L. More preferred, the component b) is contained in the range from 0.0012 to 1.4 M/L, most preferred in the range from 0.003 to 1 M/L, often in the range from 0.005 to 0.5 M/L. The concentration is calculated with a crystal water content if present.

A low phosphate concentrated electrolyte solution may provide a harder coating, but sometimes with a less high corrosion resistance. A high phosphate concentrated electrolyte solution may provide a thick, fragile coating with a lower hardness, but often with a high corrosion resistance.

The composition of the electrolyte solution contains preferably a moiety of at least one sodium containing silicate, at least one potassium containing silicate, at least one ammonium containing silicate, at least one of their derivatives or any mixture of them. The composition of the electrolyte solution may contain any amount of at least one alkali metal silicate, preferably of a sodium or a potassium silicate, more preferably added as "liquid glass".

The composition of the electrolyte solution contains preferably a moiety of at least one alkali metal silicate or of any monomer, of any polymer or of even both of any silicon containing compound like any silane, any silanol, any siloxane or any polysiloxane or at least one of their derivatives or any mixture of them. Favorably, this composition contains at least one compound chosen from sodium containing silicate, sodium containing silicon oxide, potassium containing silicon oxide and potassium containing silicate. Alternatively or additionally to at least one other silicon containing compound, it is preferred to add any silicon containing sol or gel e.g. on the base of at least one alkali metal silicate like water glass.

The composition may preferably contain a total concentration of the at least one silicon containing compound in said electrolyte solution in the range from 0.5 g/L to 70 g/L, more preferred in the range from 1 to 50 g/L, most preferred in the range from 1.5 to 30 g/L, often in the range from 2 to 15 g/L, whereby the concentration is calculated under consideration of a crystal water content if present. This total concentration may especially be e.g. 3, 6, 9, 12, 15, 18, 21, 24, 27, 30, 33, 36, 39, 42, 45, 48, 51, 54, 57 or 60 g/L.

Too high a concentration of the at least one silicon containing compound in the electrolyte solution may provide fragile coatings. Furthermore, a high concentration of the at least one silicon containing compound in the electrolyte solution may accelerate its polymerization and may truncate the life time of the electrolyte solution. To low of a concentration of the at least one silicon containing compound in the electrolyte solution may provide less hard coatings. In certain instances, especially on aluminum poor or aluminum free metallic surfaces, the hardness of the generated coating is at least by a greater extent determined by the content of silicon oxide(s) if there should be a low content of aluminum oxide(s).

The composition may preferably contain a total concentration of the at least one silicon containing compound in said electrolyte solution in the range from 0.001 to 2 M/L, more preferred in the range from 0.003 to 1.4 M/L, most preferred in the range from 0.007 to 0.8 M/L, often in the range from 0.01 to 0.5 M/L, whereby the concentration is calculated under consideration of a crystal water content if present.

The composition may preferably contain a total concentration of at least one hydroxide of Na, K, Li or $NH_4$ or of any mixture of them of no more than 0.8 g/L in the electrolyte solution, more preferred no more than 0.6, 05. or 0.4 g/L or even no more than 0.3, 0.2 or 0.1 g/L or optionally none. This concentration may show, but must not show only intentionally added moieties, but may even enclose moieties that are dragged in the process succession e.g. from an earlier bath or that are impurities of other components or both. The hydroxide may be—at least partially—contained as anions; then it may be preferred that the content of OH—anions shows a concentration that corresponds as calculated in molar weights to the concentration of the hydroxides mentioned in this paragraph. The concentration of OH—anions in the electrolyte solution may be significantly smaller than the concentration of cations of Na, K, Li or $NH_4$ or of any mixture of them, e.g. less than 80% or less than 60% or less than 40% or even less than 20%.

The composition of the electrolyte solution may preferably show a total concentration of cations and compounds of Na, K, Li or $NH_4$ calculated as Na, K, Li or $NH_4$ of no more than 0.3 M/L, more preferred no more than 0.225 or 0.15 M/L or even no more than 0.075 M/L or optionally none.

Amongst the cations of Na, K, Li, NH4 or any mixture of them, the content of ammonium cations is generally less favorable because it seems that it does not take a significant part in the formation of the coating. Because of environmental reasons, it may be preferred to use a content or a higher content of potassium cations instead of e.g. sodium cations.

The composition of the electrolyte solution may contain alkaline earth metal cations preferably in a concentration of no more than 3 g/L, more preferred of no more than 2.5 or 2 g/L or even of no more than 1.5, 1 or 0.5 g/L or optionally none.

There may be a moiety of alkaline earth metal compounds respectively of alkaline earth metal cations in the electrolyte solution. It is preferred that this moiety of alkaline earth metal cations present in the electrolyte solution is kept in a range from 0.001 to 3 g/L, more preferred in a range of up to 2 g/L or up to 1.5 g/L, most preferred in a range of up to 1 g/L or up to 0.5 g/L. These alkaline earth metal cations in the electrolyte solution are preferably such cations like calcium, magnesium or any of their mixtures. The content of alkaline earth metal cations may be integrated into the coatings to a high percentage or even totally. Of course, a similar content may occur from magnesium rich surfaces by chemical, electrochemical or thermal reaction or any mixture of these. Nevertheless, it may in some cases be preferred that the addition of such cations is kept quite low or even zero.

The composition of the electrolyte solution may contain transition metal cations preferably in a concentration of no more than 3 g/L, more preferred of no more than 2.5 or 2 g/L or even of no more than 1.5, 1 or 0.5 g/L or optionally none.

There may be a moiety of transition metal compounds including lanthanide compounds respectively of transition metal cations in the electrolyte solution. It is preferred that this moiety of transition metal cations present in the electrolyte solution is kept in a range from 0.001 to 3 g/L, more preferred in a range of up to 2 g/L or up to 1.5 g/L, most preferred in a range of up to 1 g/L or up to 0.5 g/L. These transition metal cations in the electrolyte solution are preferably such cations like cerium, iron, manganese, niobium, yttrium, zinc or any of their mixtures. The content of alkaline earth metal cations may be integrated into the coating to a high percentage or even totally. Of course, a similar content may occur from iron or titanium rich surfaces by chemical, electrochemical or thermal reaction or any mixture of these. Nevertheless, it may in some cases be preferred that the addition of such cations is kept quite low or even zero.

The composition of the electrolyte solution may contain anions other than oxides, phosphorus containing oxyanions and silicates preferably in a concentration of no more than 3 g/L, more preferred of no more than 2.5 or 2 g/L or even of no more than 1.5, 1 or 0.5 g/L.

There may be a moiety of compounds showing anions other than phosphorus containing oxyanions or silicon containing oxyanions in the electrolyte solution like an aluminate, a carbonate, a carboxylate, a titanate, a zirconate or any mixture of these. It is preferred that this moiety of anions added to or present in the electrolyte solution is kept in a range from 0.001 to 3 g/L, more preferred in a range of up to 2 g/L or up to 1.5 g/L, most preferred in a range of up to 1 g/L or up to 0.5 g/L. The content of these anions may be integrated into the coating to a high percentage or even totally, but the decomposition of organic anions and, e.g., of carbonates will then lead in such cases to a lowered amount in the coating. Nevertheless, it may in some cases be preferred that the addition of such anions is kept quite low or even zero.

The composition of the electrolyte solution may contain anions of mineral acids or organic acids other than oxides, phosphorus containing oxyanions and silicates preferably in a concentration of no more than 0.2 M/L, more preferred of no more than 0.12 M/L or even of no more than 0.6 M/L.

The composition of the electrolyte solution may additionally contain at least one peroxide. The peroxide may be used as source for oxygen for the oxidation especially of the base metal going to be anodized. The said peroxide may preferably be hydrogen peroxide, sodium peroxide, potassium peroxide or any mixture of them. Alternatively, other sources of oxygen may be used instead of peroxide or additionally to it, but peroxide is favored because it is environmentally very friendly.

The composition of the electrolyte solution may preferably contain the at least one peroxide additionally contained in the electrolyte solution in a concentration preferably in the range from 0.01 g/L to 20 g/L—calculated as 100% of $H_2O_2$, more preferred in the range from 0.03 to 14 g/L, most preferred in the range from 0.06 to 8 g/L, often in the range from 0.1 to 2 g/L. The electrolyte solution of the present invention may optionally contain a peroxide like hydrogen peroxide. The concentration of said hydrogen peroxide is preferably in the range from 0.01 to 50 g/L calculated in the form of 20 to 30% $H_2O_2$ or preferably in the range from 0.03 to 20 g/L calculated in the form of 100% $H_2O_2$.

If it is intended to add any peroxide, it is preferred that there is a certain content of it in the electrolyte solution as the peroxide may be consumed by chemical reactions in a certain amount during the anodizing. Nevertheless, it is not necessary to add very high amounts of peroxide(s).

Oxygen provided by the dissociation of the peroxide may accelerate the plasma-chemical reactions and may often improve the properties of the generated coating which may gain the properties of a ceramic coating, especially if there is a sintering during the anodizing. However, a too high concentration of peroxide may sometimes decrease the stability of the electrolyte solution significantly because of the gelling effect of the electrolyte solution. Generally, the addition of peroxide or any other oxygen delivering compound is optional but it is recommended when compounds of Al, Ti or Zr are added because of the high sintering temperature of the oxides of said chemical elements. Therefore, the peroxide additive is recommended in order to reach a high sintering rate. Additionally, the use of the sol-gel structures of said compounds may help to decrease the sintering temperature necessary or favorable to generate an excellent ceramic coating. If there is no or an insufficient content of peroxide, these favorable effects are not to be observed or are lowered.

The composition of the electrolyte solution may contain at least one compound containing atoms of Al, Ti, Zr or any mixture of these atoms or any mixture of these compounds additionally contained in the electrolyte solution which is water-soluble or which is water-insoluble. Such water-insoluble compound(s) may be contained in the electrolyte solution in the form of particles showing a particle size distribution for all these particles preferably essentially in the range from 0.01 to 20 microns, more preferred essentially in the range from 0.05 to 18 microns, most preferred essentially in the range from 0.1 to 15 microns, often essentially in the range from 0.5 to 12 microns. The wording "essentially" shall mean that there must not be 100% of the particle size distribution within the ranges mentioned, but a main proportion of it, e.g. at least more than 50%, e.g., 65% or more of the particle size distribution calculated by particle numbers.

The composition may preferably contain the at least one compound containing atoms of Al, Ti, Zr or of any mixture of these atoms or of any mixture of these compounds additionally contained in the electrolyte solution in a total concentration in the range from 0.01 g/L to 50 g/L, more preferred in the range from 0.03 to 30 g/L, most preferred in the range from 0.06 to 10 g/L, often in the range from 0.1 to 1 g/L, e.g., 3, 6, 9, 12, 15, 18, 21, 24, 27, 30, 33, 36, 39, 42, 45 or 48 g/L.

The composition may preferably contain the at least one compound containing atoms of Al, Ti, Zr or of any mixture of these atoms or of any mixture of these compounds additionally contained in the electrolyte solution in the range from 0.0001 to 1 M/L, more preferred in the range from 0.0005 to 0.5 M/L, most preferred in the range from 0.001 to 0.2 M/L, often in the range from 0.005 to 0.05 M/L.

The composition wherein said at least one compound comprising atoms of aluminum is preferably at least one aluminate like sodium aluminate or potassium aluminate or both of them, whereby the aluminate(s) may be contained in the electrolyte solution in a concentration of all of these at least one of these aluminates preferably in the range from 0.1 g/L to 50 g/L, more preferred in the range from 1 to 30 g/L, e.g. 3, 6, 9, 12, 15, 18, 21, 24 or 27 g/L.

The composition of the electrolyte solution may contain as solvent a) water or b) water and at least one alcohol, preferably c) only water and ethanol or d) water and a glycol such as, for example, ethylene glycol or e) water and at least one silane or at least one silanol or at least one siloxane or any combination of them.

As would be understood to one skilled in the art that also compounds of other metals or nonmetals or any additives or both of them such as, for example, PTFE, any organic polymer any e.g. epoxy groups containing polymer, any lubricant such as, for example, molybdenum sulfide, any surfactant, any organic solvent like an alcohol, any silane, any silanol, any siloxane, any polysiloxane, any derivative of these compounds or any mixture of these may be incorporated to the electrolyte solution.

The composition of the electrolyte solution may optionally include the at least one solvent besides of water preferably in a total concentration in the range from 0.01 to 500 g/L, more preferred in the range from 0.5 to 200 g/L, most preferred in the range from 5 to 50 g/L.

The composition of the electrolyte solution may contain the at least one solvent besides of water preferably in a total concentration in the range from 0.02 to 25 M/L, more preferred in the range from 0.1 to 10 M/L, most preferred in the range from 0.25 to 2.5 M/L.

The electrolyte solution shows a pH preferably greater than 7, greater than 8 or greater than 9, more preferred greater than 10 or even greater than 11; the pH may especially be in a range from 8 to 14, in a range from 9 to 13 or even in a range from 10 to 12; on the other hand, the pH may be often below 13 or below 12. The pH is preferably less than 14 or less than 13, more preferred less than 12.

The alkaline pH value is preferably achieved or during the anodizing process further adjusted, at least partially, by an addition of at least one alkali metal silicate or at least one alkali metal pyrophosphate or both.

The electrolyte solution of the present invention is preferably basic. To increase the pH in some cases, there should not be added or not primarily added at least one hydroxide component. The method of the present invention excludes the use of high contents of alkali metal hydroxides and of ammonium hydroxide in order to ensure that the pH of the electrolyte solution is in the desired range without increasing the risk of the early gelling effect of the electrolyte solution. It is preferred, to add other very alkaline compounds like a pyrophosphate to adjust the pH to higher values. Alternatively or additionally, the pH may be adjusted by the addition of an amount of "liquid glass", this is water glass, which shows a content of at least one hydroxide like sodium hydroxide or potassium hydroxide or both. It has been found that a significant addition of water glass does not negatively affect the properties of the electrolyte solution with such low hydroxide contents as by addition of a metal hydroxide. Although not wishing to be bound to any theory, it is believed that an increasing presence of at least one alkali metal hydroxide compound, often in ionic form, in the electrolyte solution increases undesirable hydroxide contents e.g. mainly of the hydroxide of the base metal of the metallic surface like mainly magnesium hydroxide in the coating especially on magnesium rich surfaces and decreases the stability of the electrolyte solution.

The Micro-Arc Oxidation Process for Metallic Surfaces:

in the method of treating a metallic workpiece, a pulsed direct current (DC) or an alternating current (AC) preferably be applied as the current between said metallic surface and said electrode. The micro-arc oxidation process of the present invention involves immersing a workpiece having at least one metallic surface in an electrolyte solution of the present invention and allowing the surface to act as an electrode of an electrical circuit.

As understood by one skilled in the art, it is necessary to control the potential of current during the micro-arc oxidation process. If the potential is very low, no sparking occurs. In contrast, a high potential leads to excessive heating of the workpiece and provides coatings with a low adhesion. Experiments have shown that effective sparking begins at a minimum of about 60 V. Above about 1000 V, the heating of the metallic workpiece is intense. As a guideline, a potential from about 70 V to about 900 V has been found to be preferably suitable for the micro-arc oxidation process according to the method of the present invention.

Also clear to one skilled in the art is that the current density during micro-arc oxidation process is changed. The current density on an initial stage of the process should be high enough to reach a stable micro-arc regime, e.g. in the range from 15 to 50 A/dm$^2$. Then the current density may be decreased by a non-controlled way to about 2-10 A/dm$^2$ or for example by a controlled decreasing method as e.g. described in SU 1713990. A stable micro-arc regime means that the plasma layer generated during the anodizing process is located essentially stable on the metallic surface going to be coated and is seen without or nearly without any change of the plasma light during the anodizing process.

Although the method of the present invention may be performed on standard anodizing equipment only allowing direct current and in some cases even pulsed direct current, the anode-cathode regime is more preferable. The ceramic layer obtained in the anode-cathode regime is more homogeneous and has a higher sintering rate. It is clear to one skilled in the art that such a sintered ceramic coating according to the invention has in most cases a higher hardness, a better wear and a better corrosion resistance than a similar coating generated only with non-pulsed direct current. In the method of treating a metallic workpiece, the current applied may preferably be an alternating current showing a frequency of the pulses in the range from 1 to 100 Hz, more preferred in the range from 10 to 85 Hz, most preferred in the range from 25 to 75 Hz, especially in the range from 45 to 65 Hz.

In the method of treating a metallic workpiece, the current applied may preferably be an alternating current showing a frequency of the pulses in the range from 10 to 1000 Hz, more preferred in the range from 100 to 850 Hz, most preferred in the range from 250 to 750 Hz, especially in the range from 400 to 650 Hz.

In the method of treating a metallic workpiece, the current density of the pulses in the applied pulsed direct current may preferably be varied in the range from 0 to 100%, more preferred starting in the range from 0 to 10% and leading up to the range from 90 to 100%.

In the method of treating a metallic workpiece, the voltage of the current applied may preferably be in the range from 60 to 1000 V, more preferred in the range from 150 to 900 V, most preferred in the range from 220 to 750 V. especially in the range from 300 to 600 V.

In the method of treating a metallic workpiece, there may preferably be an average current density during the application of the current in the range from 2 to 50 A/dm$^2$, mentioned only for the process without the first ten seconds and without the last about ten seconds of current applied for the actual coating process, more preferred in the range from 4 to 40 A/dm$^2$, most preferred in the range from 7 to 32 A/dm$^2$, especially in the range from 10 to 25 A/dm$^2$.

In general, when e.g. aluminum surfaces, magnesium surfaces or combinations of these are anodized according to the methods known in the art, sparking occurs. The sparking will often form large pores on the anodized surface, e.g. of up to about 0.5 mm diameter, rendering the surface susceptible to corrosion and for some applications unesthetic. In contrast thereto, when the anodizing of the present invention is performed in the sparking regime, the pores in the coating generated are very small, often typically not visible on the surface of the anodizing coating with the naked eye.

Since the electrical parameters of the anodizing process are dependent on many factors including the exact composition of the bath, the shape of the bath and the size and shape of the workpiece itself, the exact details of the electrical current are not generally critical to the present invention and are easily determined, without undue experimentation, by one skilled in the art performing anodizing as described herein.

According to a feature of the present invention, the current density can be chosen at any given anodizing potential so as to be sufficient to reach the controlled micro-arc regime-which may occur at a current density especially in the range from 5 to 50 A/dm$^2$, often in the range from 8 to 40 A/dm$^2$, most preferred in the range from 10 to 30 A/dm$^2$. Even the voltage used is often significantly high. To reach a controlled micro-arc regime, it seems to be primarily necessary to have a specific chemical composition of the electrolyte solution. Therefore, the conditions for a controlled micro-arc regime are quite different from those for a controlled micro-sparking regime. During the anodizing according to the controlled micro-arc regime, micro-plasma arcs are observed on the metallic surface to be coated during the anodizing process, especially as small sparks, but often all the surface(s) or nearly all the surface(s) to be coated show blue sparks similar to neon lights, typically like a plasma layer e.g. of up to 3 mm height. Typically, the micro-arc regime is dependent on the electrical and chemical conditions, which means for this invention that it is especially combined with the typical ranges of the current density and of the chemical composition. The term "controlled micro-arc regime" as used herein means that the micro-plasma arcs do not provide burnings in the anodizing coating which cause damage of the coated workpieces. The control of the "controlled micro-arc regime" may preferably be carried out by controlling the current density, the voltage or both together with the control of the chemical composition of the electrolyte solution like the pH and the silicon content.

As it is clear to anyone skilled in the art, it is necessary to control the potential of the current during the anodizing process. The potential used for the process according to the invention is preferably in the range from 200 to 1500 V, more preferred in the range from 250 to 1000 V, most preferred in the range from 300 to 800 V. A high potential leads to a strong heating of the workpiece treated. Experiments did show that an effectively controlled micro-arc regime may often begin at a minimum of about 200 V. Above about 1000 V the heating of the workpiece may in some cases be too intense and may sometimes even damage the workpiece. The smaller the metallic sample that is going to be anodized, the smaller may be the voltage. As a guideline, a potential in the range from 280 V to 850 V has been found to be mostly suitable for the anodizing according to the process of the present invention. These ranges are the same for AC and DC applications.

According to a feature of the present invention, the current density may be chosen so as to be sufficient to reach a controlled micro-arc regime. Generally, this controlled micro-arc regime may be very often reached at a current density in the range from 12 to 25 A/dm$^2$ of the surface.

The current regime may preferably be a pulsed anodic direct current or an anode-cathode regime using alternating current. It has been found that these two types of regimes are better than a non-pulsed direct current because there seems to be a higher content of oxides generated in the coating, roughly estimated e.g. 80 to 99% of oxides by alternating current, 30 to 70% by pulsed direct current instead of 25 to 50% of oxides for non-pulsed direct current—estimated for comparable process conditions. Further on, it seems to be favorable to use as far as possible rectangular or essentially rectangular forms of the current or of the current density or of both for the pulsed anodic direct current or for the anode-cathode regime using alternating current. When an anode-cathode regime is used, the industrial frequency in the range from 45 to 65 Hz is preferred, especially in the range from 50 to 60 Hz. However, especially a higher frequency may also be well applicable.

The present invention concerns especially a micro-arc oxidation process, especially for surfaces of magnesium rich or aluminum rich surface(s) or for both types of surfaces or for a mixture of surfaces containing partially magnesium ich or aluminum surface(s) or for both in an electrolyte solution of the present invention.

Preferably, the temperature of the electrolyte solution is maintained especially during said passing of a current, if necessary by cooling or by heating or by both, in the range from 0 to 60 more preferred in the range from 10 to 50° C., most preferred in the range from 15 to 40° C., often in the range from 18 to 35° C.

In the method of treating a metallic workpiece, a coating may preferably be formed within less than 150 minutes of passing the current through said electrolyte solution, more preferred within less than 80 minutes, most preferred within less than 50 minutes, especially within less than 20 minutes.

In the method of treating a metallic workpiece, a coating may preferably be formed with an average forming rate of at least 1 μm thickness per minute during the time of passing the current through said electrolyte solution, more preferred of at least 2 μm/min, most preferred of at least 3 μm/min, especially in the range from 4 to 12 μm/min, often of about 5 μm/min.

In the method of treating a metallic workpiece, a micro-arc oxidation coating, a typical anodizing coating or a coating intermediate between these types may preferably be formed. The micro-arc oxidation coating typically shows in many cases a higher oxide(s) content than hydroxide(s) content. The anodizing coating typically shows in many cases a higher hydroxide(s) content than oxide(s) content.

In the method of treating a metallic workpiece, a micro-arc oxidation process may preferably be used.

In the method of treating a metallic workpiece, a hydroxide and oxide containing coating may preferably be formed.

In the method of treating a metallic workpiece, an oxide rich sintered coating may preferably be generated, especially with a content of oxides in the coating of at least 60% by weight, of at least 70% by weight, of at least 80% by weight or of at least 90% by weight.

In the method of treating a metallic workpiece, the metallic surfaces may preferably be selected from surfaces that are at least partially surfaces of aluminum, aluminum containing alloys, aluminum alloys, beryllium, beryllium containing alloys, beryllium alloys, magnesium, magnesium containing alloys, magnesium alloys, titanium, titanium containing alloys and titanium alloys, iron, iron containing alloys and iron alloys or any mixtures of them, more preferred they are at least partially surfaces of aluminum, aluminum containing alloys, aluminum alloys, magnesium, magnesium containing alloys, magnesium alloys, titanium, titanium containing alloys and titanium alloys or any mixtures of them; most preferred they are at least partially surfaces of aluminum, aluminum containing alloys, aluminum alloys, magnesium, magnesium containing alloys, magnesium alloys, titanium, titanium containing alloys and titanium alloys or any mixtures of them.

Herein further, the term "magnesium surface" is understood to mean at least one surface of magnesium metal or of magnesium-containing alloys or of any combination of them. The magnesium alloys include but are not limited to AM50A, AM60, AS41, AZ31, AZ31B, AZ61, AZ63, AZ80, AZ81, AZ91, AZ91D, AZ92, HK31, HZ32, EZ33, M1, QE22, ZE41, ZH62, ZK40, ZK51, ZK60 and ZK61.

Development of the Anodizing Coating

The anodizing coating produced during the anodizing may be produced with a composition of an aqueous electrolyte solution according to the invention.

While not wishing to be bound to a known theory or mechanism or to propose a new theory or mechanism, it is believed that a formation of phosphate(s) and silicon containing polymers in the first layer on the metallic surface will mostly occur at the beginning of the anodizing. Then a deposition of said polymers on the metallic surface(s) may increase the micro-arc formation and, by this phenomenon, the hardness of the generated coating may improve. During the anodizing, often first at least one hydroxide may be forming part of the beginning coating whereas this may be partially, mostly or totally transformed to at least one oxide like at least one silicon oxide, magnesium oxide, aluminum oxide or any mixed oxide or any mixture of them; this coating showing an intermediate stage of the development of the coating is herein called "basic coating". This basic coating may be improved if there would be a sintering later on, preferably if there is a content of at least one compound containing Al, Ti, Zr or any mixture of these chemical elements. By sintering this more or less oxide containing coating at elevated temperatures, a ceramic coating will be generated. All the stages during the development of the coating show a continuous transition and are not clearly separated. It is assumed that a formation of phosphate(s), phosphide and silicon containing oxide(s) and silicon phosphide in the coating will mostly occur. Furthermore, the phosphate content in the electrolyte solution may provide a formation of compounds that may be water-insoluble or nearly water-insoluble such as phosphates of aluminum, beryllium, magnesium, iron, titanium or phosphides of aluminum, beryllium, magnesium, iron, silicon, titanium or any of their mixtures.

The coating generated during the anodizing process, especially during the micro-arc oxidation process, may preferably show a composition comprising 1) at least one oxide, 2) at least one phosphorus containing compound and 3) optionally, but often, at least one hydroxide. This coating may preferably show a composition comprising 1) at least one of the compounds selected from the group consisting of silicon oxides, magnesium oxides, aluminum oxides and any mixture of them, 2) at least one of the compounds selected from the group consisting of phosphates, phosphides and any mixture of these compounds and 3) optionally, but often, at least one hydroxide.

This coating may preferably be a composition comprising a) at least one phosphate or at least one phosphide or any mixture of these and b) at least one oxidic silicon containing compound and c) at least one compound having cations of the base metal of the metallic material whereby hereof at least one compound may be identical with at least one of the compounds of a) or of b) or of both.

Such compound(s) containing at least one chemical element chosen from Al, Ti, Zr and any mixture of these may penetrate into the coating layer during the oxidation process, especially compounds in the form of particles. The energy of a plasma-chemical reaction on the metallic surface(s) is necessary for the decomposition of the compounds and for the oxidation of the metals and enhances then a sintering of the metallic oxides with the basic coating. This method allows to modify the basic coating and to obtain a variety of coatings with an improved hardness, an improved thermal resistance and sometimes with improved other properties like a further reduced porosity, like electrically insulation, piezoelectric properties or ballistic shielding properties or any combination of them. The content of compound(s) comprising atoms of Al, Ti, Zr or any mixture of these chemical elements is preferably in the range from 0.1 to 99% by weight of all phases of the coating, more preferred in the range from 1 to 50% by weight. This indicates, that such atoms may be sometimes distributed broadly in the coating. Additionally, when at least one Zr compound is used, at least one stabilizer like at least one compound selected from the group consisting of alkaline earth metal containing compounds, lanthanide containing compounds and yttrium compounds may be added to the electrolyte solution in order to stabilize the generated zirconium oxide. An example of said stabilizers may preferably be cerium oxide or yttrium oxide. The coating may then preferably show a composition comprising at least one compound containing Al, Ti, Zr or any mixture of them.

The generated coating may in many cases be slightly or intensively sintered as there are often temperatures applied in the range from 1000 to 2000° C. during the anodizing and especially during the micro-arc oxidation process. According to first observations, the microhardness of an unsintered coating on a magnesium alloy may e.g. be roughly about 90 to 95 $HV_{50}$, of a partially sintered coating e.g. roughly about 150 to 200 $HV_{50}$ and of a well sintered coating e.g. roughly about 400 to 450 $HV_{50}$. Even the corrosion resistance seems to be according to first observations roughly proportional to the sintering degree: The corrosion resistance by tests in 5% salt fog in accordance with ASTM D117 may e.g. be roughly about few hours for an unsintered coating on a magnesium alloy, may e.g. be roughly about 240 to 300 hours for a partially sintered coating on a magnesium alloy and may e.g. be roughly about 1000 hours for a well sintered coating on a magnesium alloy. It is estimated that the porosity may show a similar development with the sintering degree. Such coatings may preferably have a content of at least 70% by weight of at least one oxide compound, more preferred of at least 80% by weight, most preferred of at least 90% by weight. Because of the excellent results, no sealing is necessary for the well sintered coatings.

The coating generating during the anodizing process may preferably gain a coating thickness in the range from 10 to 300 μm, more preferred in the range from 20 to 250 μm, most preferred in the range from 25 to 190 μm, often in the range from 30 to 150 μm, especially at least 40 μm or up to 120 μm, sometimes of about 50 or 60 μm.

It was surprising that excellent coatings showing a very high corrosion resist even on unsealed surfaces especially of magnesium rich materials could be gained. All coating generated according to this invention that give at least a certain corrosion resistance shall be seen as protective coatings.

It was surprising that for the process according to the invention electrolyte solutions could be very successfully used that contain only environmentally friendly compounds.

It was surprising that excellent coatings could be generated even with a coating rate of at least 3 μm/min, sometimes of at least 6 μm/min, calculated as average over the practically whole anodizing time.

Further on, it was surprising that excellent coatings could be generated even within less than 30 minutes, partially even in a time period in the range from 1 to 25 minutes.

It was surprising that a ceramic coating which was well sintered and showed a typical coating thickness of about 50 μm, an excellent corrosion resistance and a high microhardness could be gained already after only 5 minutes of anodizing.

EXAMPLES AND COMPARISON EXAMPLES

The following sections describe specific examples and comparison examples with the target to show some of the possible process varieties, composition varieties and the effects related thereto more in detail and not to limit the invention.

Section 1: Preparation of the Different Electrolyte Solutions and Trials for Coating:

In the following, the preparation procedure of the electrolyte solutions as mentioned in Table 1 is described. An amount of $Na_2HPO_4.2H_2O$ was dissolved in 500 ml of water. To this solution, an amount of $K_4P_2O_7$ was added and thoroughly mixed. Then, $Na_2SiO_3$ as water glass was added to this solution as commercially available "liquid glass" solution and again thoroughly mixed. Finally, water was added to adjust the electrolyte solution to 1 liter of an electrolyte solution of the present invention. In some of these examples, hydrogen peroxide and sodium aluminate were added.

TABLE 1

Compositions and pH values of the aqueous electrolyte solutions of the examples according to the invention

| Solution No., | Unit | Example No. 1 | 2 | 3 | 4 | 5 |
|---|---|---|---|---|---|---|
| $Na_2HPO_4$ | g/L | 18 | 9 | 7 | 2 | 2 |
| $K_4P_2O_7$ | g/L | 33 | 16 | 13 | 5 | 5 |
| $Na_2SiO_3$* | ml/L | 50 | 25 | 20 | 7 | 7 |
| $H_2O_2$ 28% | ml/L | — | — | 10 | — | 5 |
| $Na_3AlO_3$ | g/L | — | — | 0.5 | — | 0.2 |
| Hydroxides added of Na, K, Li, $NH_4$ | g/L | 0 | 0 | 0 | 0 | 0 |
| pH | — | 11.8 | 11.5 | 11.5 | 11.2 | 11.3 |
| coating thickness, about | μm | 47 | 53 | 45 | (50) | (50) |

*as liquid glass = water glass in the form of 20% of this silicate in aqueous liquid with a specific gravity of 1.3 g/cm$^3$, data including the water content.

First, the plates and sheets of the aluminum respectively magnesium alloys used for the further process were cleaned in an alkaline cleaning solution. The coating of these sheets was performed in a cooled laboratory tank with a stainless steel (SS316) electrode as the cathode and with direct pulsed current of a voltage of up to 200 V for every sample, with a current density of 10 to 25 A/dm$^2$ with the maximum shortly after starting and with a continuous uncontrolled decrease of the current density for every sample as well as at a temperature of the electrolyte solution of about 25° C.

With the compositions according to Table 1, coatings were generated on the surfaces of the magnesium alloys AZ31B, ZK60 and AZ91D as well as on those of the aluminum alloys Al5053 and Al6061 for each solution mentioned in Table 1 over 5 minutes. All these coatings showed good or even excellent results depending on the composition of the electrolyte solution. The coatings generated on these magnesium alloys and aluminum alloys showed almost the same coating characteristics one to the other prepared with these significantly alkaline electrolyte solutions. It was further found that the samples coated in the medium concentrated electrolyte solution No. 2 according to the invention had a slightly higher coating thickness when using exactly identical coating times and showed a better corrosion resistance than in the examples Nos. 1 and 3.

Comparison example No. 1 in a standard sulfuric acid hard anodizing process: Parallel hereto, the aluminum alloys Al5053 and Al6061 were tested according to the standard sulfuric acid hard anodizing electrolyte solution in accordance with Mil-A-8625 F Type III Class 1. The coating was generated with a coating thickness of about 50 μm.

Comparison example No. 2 in a standard sulfuric acid hard anodizing process: Further on, panels of aluminum Al2024 were parallelly thereto coated by a hard anodizing process in accordance with Mil-A-8625 F Type III Class 1 and were sealed afterwards in a hot nickel acetate solution as described in Mil-A-8625 F. These panels showed coatings of about 50 μm coating thickness.

Comparison example No. 3 in a conventional alkaline anodizing process for magnesium rich surfaces showing typically excellent corrosion resistance properties: Finally, panels of the magnesium alloys AZ91D and AZ31B were coated in an anodizing solution number A as described in WO 03/002773 for 10 minutes at 25° C. with a current density of between 2 and 4 A/dm$^2$. This solution was prepared with 0.2 mole of $Na_2HPO_4.2H_2O$ were dissolved in 500 ml of water. To this solution 25 ml of 50% solution of $NH_2OH$ were added and thoroughly mixed. To this solution was added 40 g of KOH and thoroughly mixed. To this solution 0.2 g of the polymeric surfactant Brij® 97 was added. Water was added to make 1 liter of the alkaline anodizing solution. This solution is used and approved in a more conventional anodizing process with a solution giving coatings of high corrosion resistance. The coating was generated with a coating thickness of about 20 μm.

It was found that all the coated panels of the magnesium alloys and of the aluminum alloys coated in a solution according to the invention (solutions Nos. 1 to 5) and with a process according to the invention showed significantly better results of corrosion resistance and hardness than the coatings of the comparison examples Nos. 1 to 3.

Additionally, a coating thickness of 50 microns was obtained with a process according to the invention already after 5 minutes of treatment in the respective electrolyte solution of the present invention. In the anodizing solutions of the comparison examples Nos. 1 and 2, the same thickness was obtained after 40 to 50 minutes of the standard sulfuric acid hard anodizing process.

Section 2: Content of Silicon in the Generated Coatings

The coatings of the panels of the magnesium alloy AZ31B coated as described in section 1 with the solutions Nos. 1 to 3 of Table 1 were analyzed on their silicon content. The content of silicon was tested with an emission spectroscope GDA-750 by Glow Discharge Optical Emission Spectroscopy. The test was performed in accordance with the Quantitative Depth Profiling Method (QDP).

Astonishingly, it was found that the samples coated in a medium concentrated electrolyte solution (solution No. 2) have the highest silicon content: 17%. The samples coated in a high concentrated electrolyte solution (solution No. 1) showed a content of 15% of silicon in the coating. The samples coated in a low concentrated electrolyte solution (solution No. 3) have a content of 12% of silicon in the coating.

Section 3: Micro-Hardness of the Generated Coatings

Panels of the magnesium alloy AZ31B coated in the electrolyte solutions Nos. 1 to 3 of Table 1 showing a coating thickness of about 50 microns were tested on their Vickers micro-hardness. All three samples showed a hardness of about 400 $HV_{50}$. As they showed only about 2 or 3 minor pores to be seen with the naked eye on an area of 0.4 dm$^2$, it is supposed that the porosity is only of roughly about 1%. The coatings were astonishingly dense and solid.

Section 4: Corrosion Resistance of the Generated Coatings

Panels of the magnesium alloy AZ91D coated in the solutions Nos. 1 to 3 for 5 minutes at 25° C. with a current density of between 10 and 25 A/dm$^2$ were used for the corrosion resistance test without any sealing after the micro-arc coating process. These samples as well as the anodized and sealed aluminum alloy panels of comparison example 2 showed coatings with a coating thickness of about 50 microns. The sealing of the panels of comparison example 2 was an impregnation of the pores of the porous anodizing coating. All these samples were tested in 5% salt fog in accordance with ASTM D117 for 1000 hours.

The aluminum alloy sample of comparison example 2 was already heavily corroded after 300 hours of the test. The magnesium alloy samples showed only 1 to 3 corrosion pits per panel surface with a diameter of less than 1 mm each after 1000 hours to be observed with the naked eye; therefore, they were significantly much more resistant against corrosion.

It was very astonishing that the coatings generated with the process according to the invention on unsealed magnesium alloys showed a very much better bare corrosion resistance than the sealed aluminum alloy although aluminum alloy surfaces themselves are much less sensitive for corrosion than magnesium alloys.

The present invention also relates to vehicles, e.g., aircraft, terrestrial vehicles such as cars and trucks, and to electronic devices including the coated products of the present invention. For example, the vehicle will comprise an engine and metal parts as prepared by the invention. Methods of making products that include the coated products described herein are also contemplated.

What is claimed is:

1. An aqueous electrolyte solution for the oxidation of a surface of at least one anodizable metallic material, the aqueous electrolyte solution comprising:

(a) a first phosphorous containing compound comprising $PO_4$, the first phosphorous containing compound at least partially soluble in the aqueous electrolyte solution;

(b) a second phosphorous containing compound comprising $P_2O_7$, the second phosphorous containing compound at least partially soluble in the aqueous electrolyte solution;

(c) a silicon containing compound which is at least partially soluble in the aqueous solution used;

(d) an amount of at least one type of cations selected from the group consisting of alkali metal cations and ammonium; and (e) at least one hydroxide of Na, K, Li, $NH_4$ or any mixture thereof in a total concentration of no more than 0.8 g/L;

wherein the aqueous electrolyte solution has a pH greater than 6, and wherein the first and second phosphorous containing compounds are at least partially soluble in the aqueous electrolyte solution.

2. The aqueous electrolyte solution of claim 1, wherein the first phosphorous containing compound is selected from the group consisting of $K_3PO_4$, $Na_3PO_4$, $(NH_4)_3PO_4$, $K_2HPO_4$, $Na_2HPO_4$, $(NH_4)_2HPO_4$, $KH_2PO_4$, $NaH_2PO_4$, and $NH_4H_2PO_4$.

3. The aqueous electrolyte solution of claim 2, wherein the second phosphorous containing compound is selected from the group consisting of $K_4P_2O_7$, $Na_4P_2O_7$ and $(NH_4)_4P_2O_7$.

4. The aqueous electrolyte solution of claim 1, wherein the aqueous electrolyte solution contains the first and second phosphorus containing compounds in a total concentration in the range from 0.2 to 250 g/L.

5. The aqueous electrolyte solution of claim 1, wherein the aqueous electrolyte solution contains the first phosphorus containing compound in a total concentration in the range from 0.1 to 220 g/L, and the second phosphorus containing compound in a total concentration in the range from 0.1 to 220 g/L.

6. The aqueous electrolyte solution of claim 1, wherein the silicon containing compound comprises a moiety of at least one alkali metal silicate or at least one of their derivatives or any mixture thereof.

7. The aqueous electrolyte solution of claim 1, wherein the aqueous electrolyte solution contains the at least one silicon containing compound in a total concentration in the range from 0.5 to 70 g/L.

8. The aqueous electrolyte solution of claim 1, wherein the aqueous electrolyte solution further comprises at least one peroxide.

9. The aqueous electrolyte solution of claim 8, wherein the aqueous electrolyte solution contains the at least one peroxide in a total concentration in the range from 0.01 to 20 g/L, calculated as 100% $H_2O_2$.

10. The aqueous electrolyte solution of claim 1, wherein the aqueous electrolyte solution further comprises at least one compound containing atoms of Al, Ti, Zr or any mixture of these atoms or any mixture of these compounds.

11. The aqueous electrolyte solution of claim 1, wherein the aqueous electrolyte solution further comprises at least one water-insoluble compound containing at least one atom selected from the group consisting of Al, Ti and Zr.

12. The aqueous electrolyte solution of claim 11, wherein the at least one water-insoluble compound is present in the aqueous electrolyte solution in the form of particles, wherein the particles have a particle size distribution for all these particles in the range from 0.01 to 20 microns.

13. The aqueous electrolyte solution of claim 11, wherein the aqueous electrolyte solution contains the at least one water-insoluble compound in a total concentration in the range of from 0.01 to 50 g/L.

14. The aqueous electrolyte solution of claim 1, wherein the aqueous electrolyte solution further comprises a solvent, the solvent selected from the group consisting of (i) water and (ii) water and at least one alcohol.

15. The aqueous electrolyte solution of claim 1, wherein the aqueous electrolyte solution further comprises at least one solvent besides water, wherein the aqueous electrolyte solution contains the solvent in a total concentration in the range of from 0.01 to 50 g/L.

16. The aqueous electrolyte solution of claim 1, wherein the first phosphorous containing compound comprises a moiety of at least one primary, secondary or tertiary phosphate or of at least one derivative or of any mixture thereof, and the second phosphorous containing compound comprises a moiety of at least one pyrophosphate or of at least one derivative or of any mixture thereof.

17. The aqueous electrolyte solution of claim 1, wherein the aqueous electrolyte solution has a pH in the range from 6 to 14.

18. The aqueous electrolyte solution of claim 1, wherein the aqueous electrolyte solution contains the at least one hydroxide of Na, K, Li, $NH_4$ or any mixture thereof in a total concentration in the range from 0.1 to 0.8 g/L.

19. A method of treating a metallic workpiece, the method comprising:

providing a surface of at least one anodizable metallic material, the at least one anodizable metallic material selected from the group consisting of magnesium and a magnesium alloy;

at least partially immersing the surface in an aqueous electrolyte solution having a pH greater than 6, the aqueous electrolyte solution comprising (a) a first phosphorous containing compound comprising $PO_4$, the first phosphorous containing compound at least partially soluble in the aqueous electrolyte solution; (b) a second phosphorous containing compound comprising $P_2O_7$, the second phosphorous containing compound at least partially soluble in the aqueous electrolyte solution; (c) a silicon containing compound which is at least partially soluble in the aqueous solution used; (d) an amount of at least one type of cations selected from the group consisting of alkali metal cations and ammonium; and (e) at least one hydroxide of Na, K, Li, $NH_4$ or any mixture thereof in a total concentration of no more than 0.8 g/L;

providing at least one electrode in the aqueous electrolyte solution; and applying a pulsed direct current or an alternating current with a current density in the range from 5 to 50 $A/dm^2$ between the surface and the at least one electrode through the aqueous electrolyte solution.

20. The method of claim 19, wherein the aqueous electrolyte solution has a pH in the range from 6 to 14.

21. The method of claim 19, wherein the aqueous electrolyte solution contains the at least one hydroxide of Na, K, Li, $NH_4$ or any mixture thereof in a total concentration in the range from 0.1 to 0.8 g/L.

22. The method of claim 19, wherein the pulsed direct current or alternating current has a frequency in the range of 1 to 1000 Hz.

* * * * *